United States Patent [19]

Yokowo

[11] 4,454,946

[45] Jun. 19, 1984

[54] COLLAPSIBLE PARTITIONED CORRUGATED CARDBOARD CONTAINER

[75] Inventor: Koichi Yokowo, Tokyo, Japan

[73] Assignees: Toppan Containers Co., Ltd.; Toppan Printing Co., Ltd., both of Japan

[21] Appl. No.: 304,201

[22] Filed: Sep. 21, 1981

[30] Foreign Application Priority Data

Sep. 22, 1980 [JP] Japan ..... 55-134899[U]

[51] Int. Cl.³ ..... B65D 19/20

[52] U.S. Cl. ..... 206/600; 229/15; 229/42; 229/41 R; 108/56.1; 220/22

[58] Field of Search ..... 206/600, 386, 83.5, 206/595-599, 600, 386, 511; 229/15, 42, 23 C, 41 R, 42, 15; 220/22, 8, 445, 1.5; 217/7, 8, 29; 108/56.1-56.3

[56] References Cited

U.S. PATENT DOCUMENTS

| | | | |
|---|---|---|---|
| 2,108,300 | 2/1938 | Sullivan | 229/15 |
| 3,108,729 | 10/1963 | Kundikoff | 229/15 |
| 3,291,364 | 12/1966 | Fischer | 206/600 X |
| 3,348,667 | 10/1967 | Beeby | 206/45.33 |
| 3,401,814 | 9/1968 | Chiswell et al. | 220/1.5 X |
| 3,580,470 | 5/1971 | Leonard | 229/15 |
| 3,595,384 | 7/1971 | Sargent et al. | 229/15 X |
| 3,640,445 | 2/1972 | Durham | 229/15 |
| 3,904,105 | 9/1975 | Booth | 229/15 |
| 3,921,893 | 11/1975 | Randle, Jr. | 229/15 X |
| 3,995,736 | 12/1976 | Lawson et al. | 206/386 |
| 4,013,168 | 3/1977 | Bamberg et al. | 206/386 |
| 4,050,604 | 9/1977 | Flanders | 206/600 X |
| 4,085,847 | 4/1978 | Jacalone | 206/600 |
| 4,174,803 | 11/1979 | Shroutz et al. | 229/15 |
| 4,226,192 | 10/1980 | Myers | 206/511 |
| 4,254,873 | 3/1981 | Cook et al. | 206/599 |
| 4,311,239 | 1/1982 | Schlicker | 206/597 |

FOREIGN PATENT DOCUMENTS

| | | | |
|---|---|---|---|
| 2086351 | 5/1982 | United Kingdom | 206/600 |

*Primary Examiner*—George T. Hall
*Assistant Examiner*—Bryon Gehman
*Attorney, Agent, or Firm*—Lerner, David, Littenberg, Krumholz & Mentlik

[57] ABSTRACT

A container comprising a pallet having a frame-like upright wall, two sets of a pair of side plates assembled on the pallet and which are bended in the form of a U-letter and opposed to form a box-like configuration, a plurality of rectangular partition plates received as longitudinal partition members within the opposed side plates, and receiving boxes in the form of a flat plate which receive the side plates and the partition plates therein when the container is not in use and which serve as lid portions to cover the top when it is in use.

6 Claims, 9 Drawing Figures

COLLAPSIBLE PARTITIONED CORRUGATED CARDBOARD CONTAINER

BACKGROUND OF THE INVENTION

This invention relates to a container comprising a combination of a so-called pallet and a box forming member made of corrugated cardboard, wherein the box forming member made of corrugated cardboard is assembled on the wooden pallet to thereby form receiving portions.

Some structures of transporting means or containers comprising a combination of a pallet and a paper box as described are well known. For example, such a structure is disclosed in Japanese Utility Model Publication No. Sho 53-6689 (Applicant: Toppan Printing Co., Ltd. et al). In this well known container, partition frames are disposed radially from a center prism-shaped support portion, each partition frame being provided with sub partition plates to form one side of a box forming portion with two receiving chambers, and one container is formed with eight receiving chambers.

Since in the aforementioned well known container, the partition frames and the sub partition plates are bonded into one body, the aforesaid eight receiving chambers cannot be varied in their space or shape, and therefore, there poses an inconvenience in which only those of determined shape and size may be received, lacking in the variety of use. In addition, in case that the partition frames and the sub partition plates are integrally bonded, even when one place is broken or damaged, the whole container becomes unusable, which is not favorable in terms of material saving.

Moreover, the corrugated cardboard container itself forming receiving portions must be formed into a complete box forming portion and must be provided with a required strength. To this end, if the partition frames and the sub partition plates are integrally bonded, the required strength can be obtained. However, if the operation for removing contents and the convenience for transportion with such elements folded for re-use are taken into consideration, the integral bonding itself will be inconvenient as the box forming portion of the container. That is, the box formation has its strength relying upon the side walls or partiton frames so that if these are bonded, when the contents are removed, the side walls or partition frames cannot be removed partly and particularly, it is extremely cumbersome to remove small articles received in the container or unused box materials in the folded conditions. Furthermore, when the containers are stored and transported as empty boxes for reuse, the box forming portion cannot be divided into sections with the result that it is bulky as a whole to pose a drawback that the work efficiency materially lowers.

It is a primary object of the present invention to provide a container made of corrugated cardboard which can change a receiving space within the range of a required magnitude and which has the excellent variety of use.

It is a further object of the present invention to provide a container made of corrugated cardboard which can be folded in a compact manner for storage and which can be transported easily.

It is another object of the present invention to provide a container made of corrugated cardboard in which even if a container forming portion is partly broken, it can be replaced simply to contribute to material saving.

It is still another object of the present invention to provide a container made of corrugated cardboard in which contents received therein can be removed easily.

DETAILED DESCRIPTION OF THE INVENTION

Figure 1:
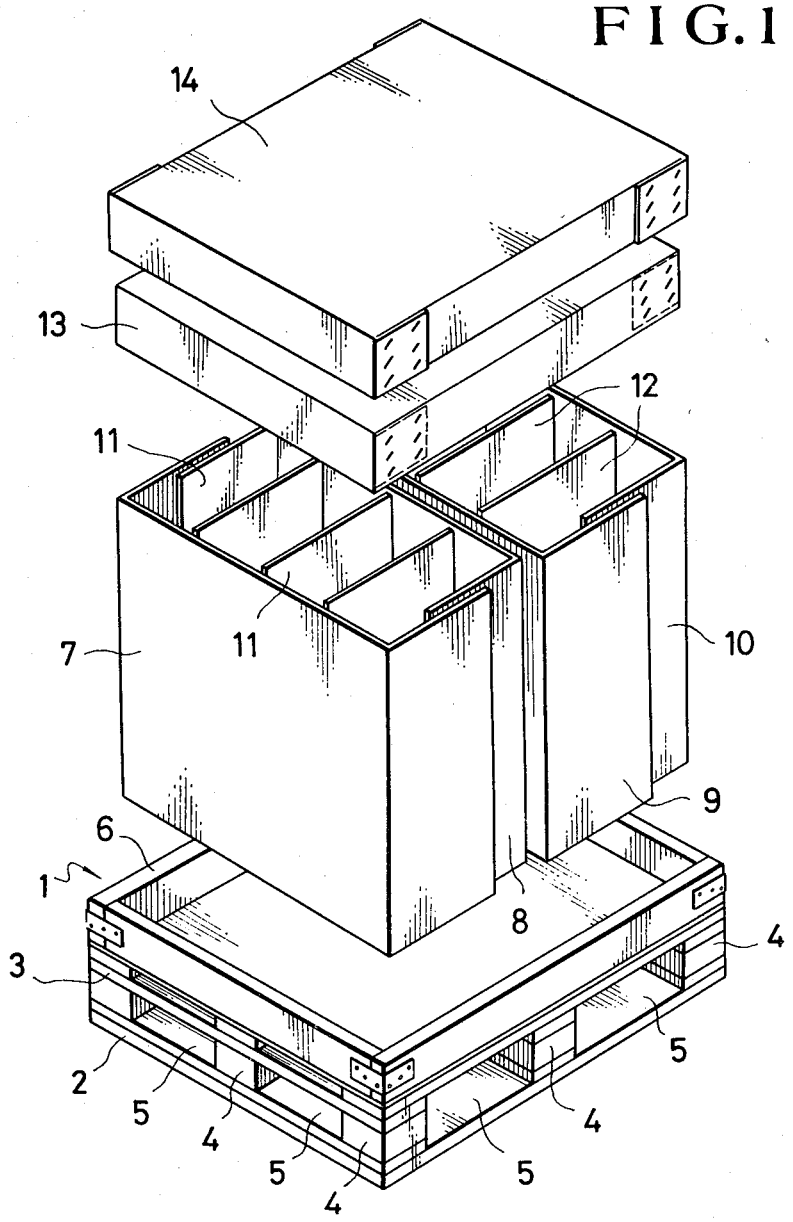
FIG. 1 illustrates a first embodiment of a container made of corrugated cardboard in accordance with the present invention and is a perspective view thereof with each of component parts when in use exploded.

Referring now to FIGS. 1 to 4 illustrating a first embodiment of the present invention, there is shown a wooden pallet 1 in which a plurality of spacers 4 are placed between two upper and lower decks 2, 3 to form openings 5 in a required spaced relation for insertion of a forklift therein, the upper deck being integrally formed with a frame-like upright wall 6 along the peripheral edge portion thereof.

A box forming portion made of corrugated cardboard assembled on the pallet and internally of the upright wall is constituted by outer side plates or partition plates 7, 8, 9 and 10 bended into a U-letter configuration. One pair of partition plates 7, 8 are positioned opposite to each other while the other pair of partition plates 9, 10 are similarly positioned opposite to each other to form respective receiving portions.

A plurality of rectangular sub partition plates 11, 12 are arranged to make longitudinal partitions within the receiving portion formed by each of said pair of partition plates. While the number of the sub partition plates used varies with the kind of articles to be received, it is noted that in the illustrated embodiment, three partition plates are used to divide each of the receiving portions into four chambers. These partition plates may not at all be used according to the kind of articles to be received.

A receiving portion or a box portion is formed by the partition plates 7–10, and a lid body placed on the top of the box portion comprises receiving boxes 13, 14 in the form of a flat plate. Both the boxes are placed one above the other into a dual form, after which they are covered on the box portion which is then tied with, for example, a string, a rope or the like including the pallet.

In case that the above-described pallet 1 and box forming members are utilized, the operation conducted from one direction of the pallet is different from that conducted from two directions thereof in the procedure of assembly, and thus both the operations will be described.

In the operation from one direction of the pallet, the partition plate 10 bended into a U-letter configuration placed in contact with the internal surface of the upright wall 6 of the pallet is first stood upright to receive therein requested articles to be received such as carton blanks. After a predetermined quantity of articles has been received, the partition plate 9 is opposed thereto and the articles are disposed in the upright wall 6 to form a box completely partitioned from outside by both the partition plates 9, 10. Next, the other partition plate 8 is disposed opposedly to the partition plate 9, and after the articles to be received have been received in a manner as described above, the partition plate 7 is disposed so as to be inserted internally of and opposedly to the upright wall to thereby form a further box in the form completely partitioned from outside. The size and shape of the thus obtained box may be suitably varied by increasing or decreasing the number of the partition plates.

Also, the interior of the box may be further divided into smaller sections by the use of a plurality of sub partition plates 11, 12. Particularly, the dimension of the pallet is often limited by the dimension of a rear body of a truck, the dimension of racks in the warehouse or transporters. Further, since the articles to be received are different, the partition plates by which a box is formed may be combined as previously mentioned to meet the requirement in the size and shape, thus increasing a degree of utilization as the container.

Figure 3:
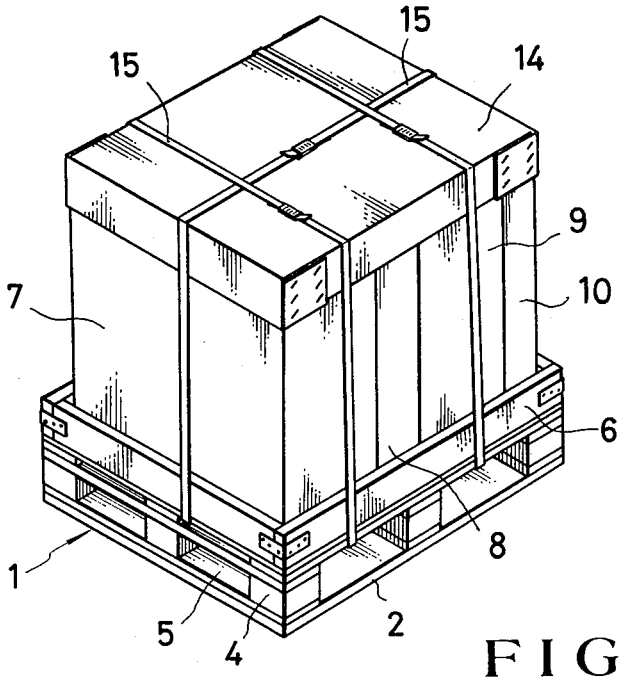
FIG. 3 is a perspective view of the container in FIG. 1 in which contents are received and packed.

Thus, after the articles have been received, the lids 13 and 14 placed one above the other are placed on the opening portion above the partition plates 7–10, and as necessary, according to the transportation conditions, the box along with the pallet may be tied with strings or ropes 15 as shown in FIG. 3.

In case that the articles received are removed at the container's destination, the lids 13 and 14 are first removed and the partition plate 7 is pulled out in such a manner that it may be raised upwardly with one side opened. Then, the articles are removed from the open side and the partition plates 8, 9 are removed to take out the articles. The operation as explained above is the case in which the operation is conducted from one side, in which case the articles are orderly packed or removed.

In case that the operation can be conducted from both sides of the pallet, in assembly of the box forming members, the partition plates 8, 9 are first opposed to each other and stood upright on the substantially central portion of the pallet, the desired articles are received internally of the respective partition plates from both sides, and thereafter the partition plates 7, 10 are faced each other and inserted internally of the upright wall 6 to form a box. In the case capable of employing the receiving mode, if the rear surfaces of the partition plates 8, 9 are bonded together, their standing up conditions are stabilized to increase the receiving operation. In the operation of inserting the partition plate 7, whether both sides of the partition plate 7 are inserted into clearances between both sides of the partition plate 8 and the upright wall 6 or between both sides of the partition plate and the article may be determined according to the operating conditions. Also, in case that the articles are removed at the container's destination, if the partition plates 7, 10 are pulled out, both sides are rendered open to facilitate the operation for removal of articles. Either operation in one direction or two directions as described above may be determined to be selected according to arrangement of operators and equipment.

Figure 2:
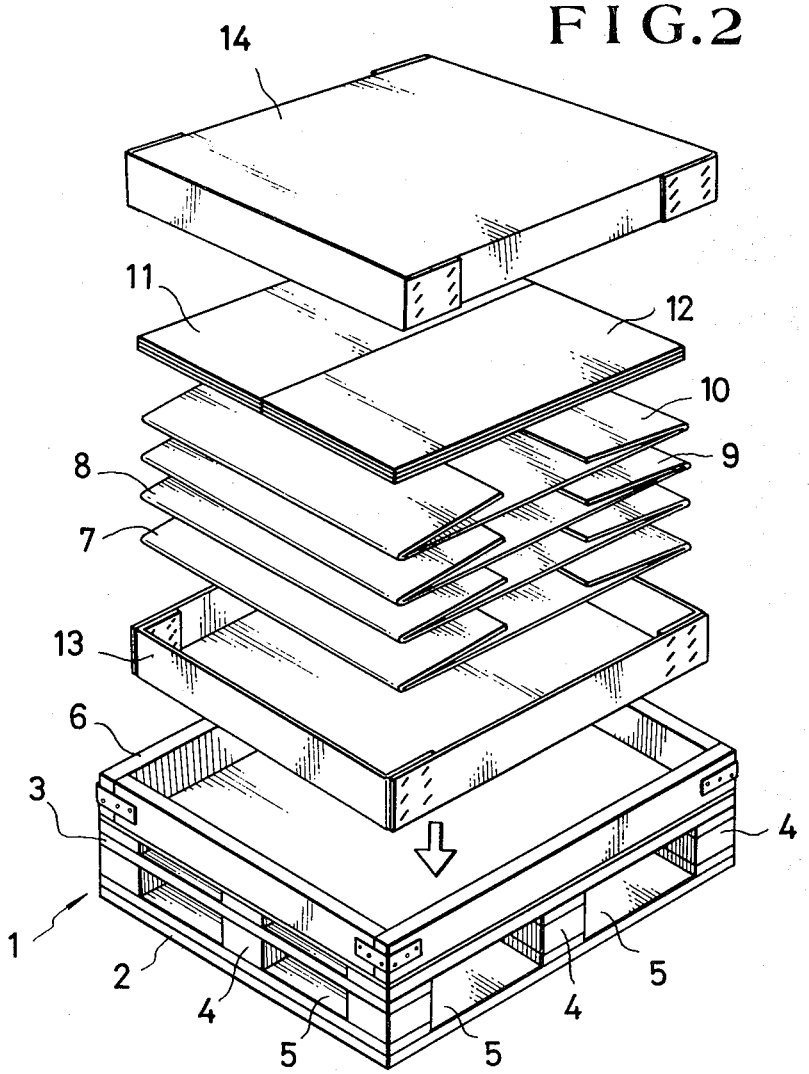
FIG. 2 illustrates the container in the first embodiment and is a perspective view thereof with each of component parts when not in use folded and hidden away.
Figure 4:
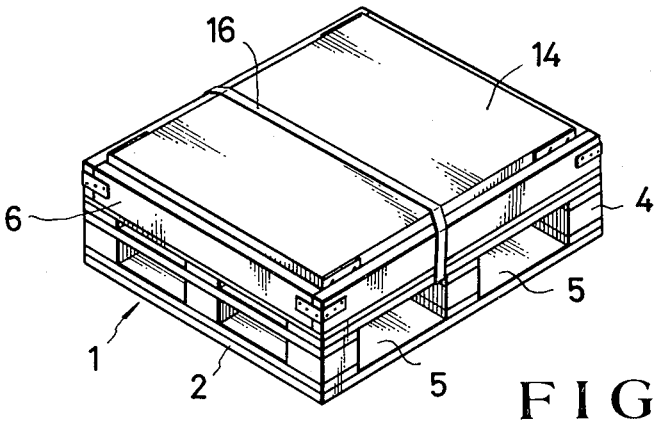
FIG. 4 is a perspective view of the container in FIG. 1 which is folded when not in use.

The box emptied after removal of articles is handled such that as shown in FIG. 2, one receiving box 13 is positioned downwardly and four partition plates 7–10 and six or more sub partition plates 11, 12 are received into the receiving box 13 in a neatly arranged condition whereas the other receiving box 14 is covered thereon to receive all of component members of the box without being dismembered and said receiving boxes are accommodated within the upright wall 6 of the pallet 1. Then, the pallet and the receiving boxes are put together by means of strings 16 or the like as shown in FIG. 4, and since the paper-made receiving boxes are protected by the frame-like upright wall 6, paper portions thereof are not damaged during transportation and during storage.

Figure 5:
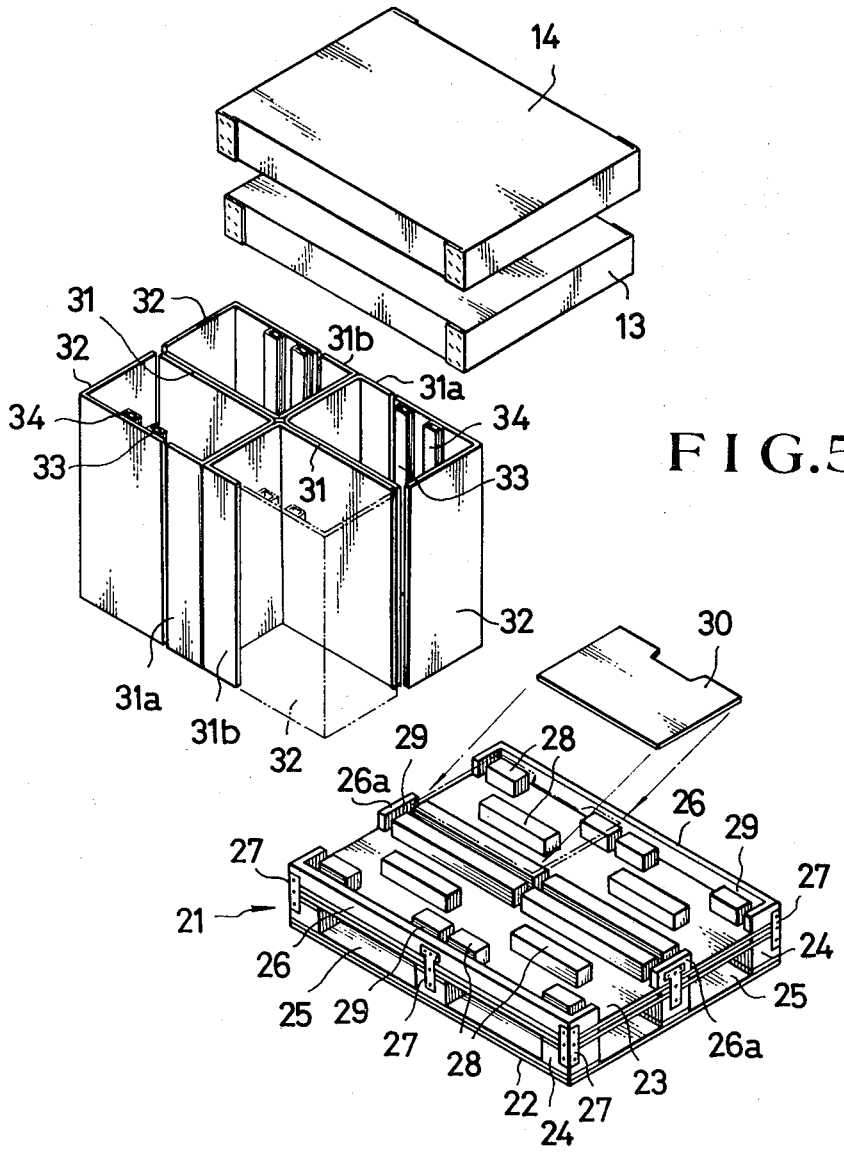
FIG. 5 illustrates a second embodiment in accordance with the present invention and is a perspective view thereof with each of component parts when in use exploded.
Figure 6:
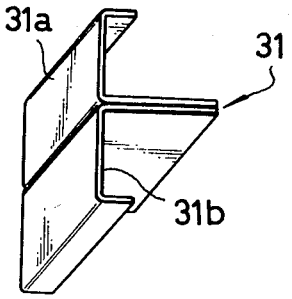
FIG. 6 is a perspective view showing the structure of one of partition plates in the second embodiment.
Figure 7:
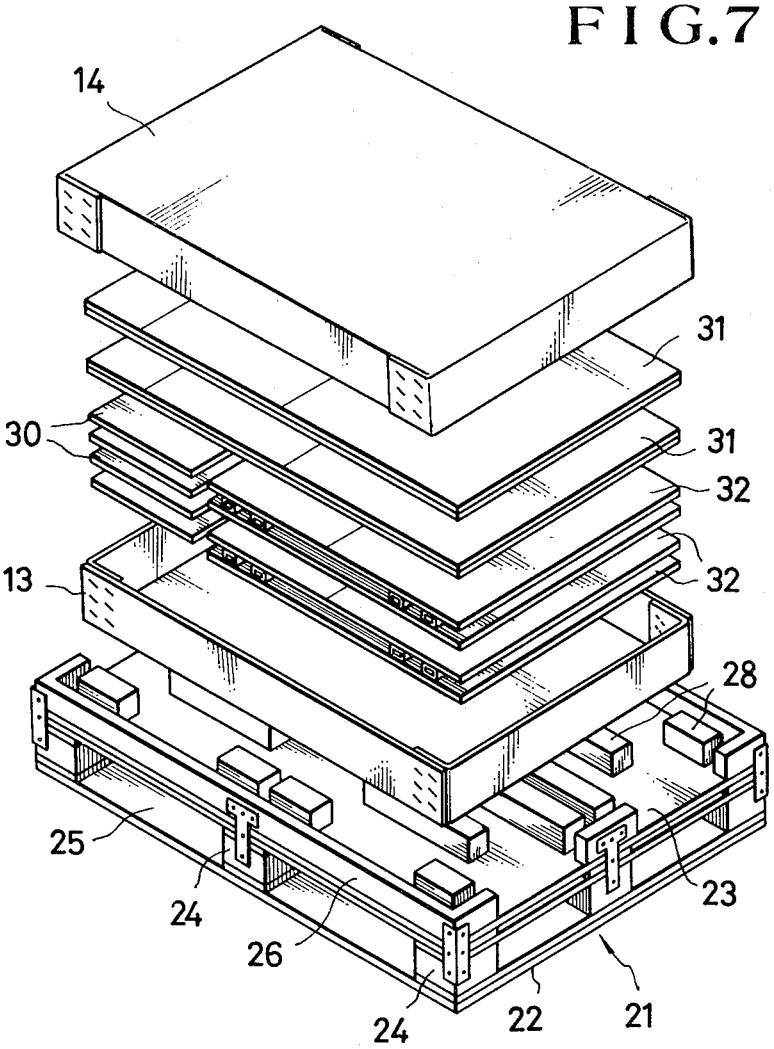
FIG. 7 is a perspective view of the container in the second embodiment with each of component parts when not in use folded and hidded away.

FIGS. 5–7 illustrate a second embodiment in which the shape of the pallet and the shape of the box forming portion are slightly modified and which is substantially the same as the first embodiment which comprises a wooden pallet and a box forming portion made of corrugated cardboard.

That is, a wooden pallet 21 used is constructed such that a plurality of spacers 24 are placed between two upper and lower decks 22, 23 to form openings 25 in a required spaced relation for insertion of a forklift therein, the upper deck being integrally formed with a frame-like upright wall 26 along the peripheral edge portion thereof, in which case, in a part of said upright wall, for example, a pair of opposed sides may be partly cutaway to form upright walls **26*a* only in the central portions thereof. In order to increase the strength of these upright walls, each upright wall is rigidly mounted by means of a reinforcing element 27 at a portion where said spacer 24 is mounted. In order to hold the lower end of the box forming portion to maintain the box forming portion to be stood upright, the upper deck 23 surrounded by the upright walls 26, 26*a* is formed thereon with plural sets (four sets) of receiving frames 28 in the form of square pillars or prisms formed of wood or expanded styrol, one set of which comprises four such prisms, and grooves 29 are provided between said receiving frames and between the upright walls 26. A bottom plate 30** formed from veneer is placed over these receiving frames.

The box forming portion is formed by a combination of an internal partition plate 31 and an external panel 32. That is, the partition plate 31 has panels **31*a* and 31*b* in the form of an L-letter as viewed from the top which are opposed each other and glued or stitched together (see FIG. 6), two sets of which are used so that L-shaped bottoms are butted so as to form a cross-like configuration in the central portion. The external panels 32 have also an L-letter configuration and are positioned at each corner portion to form a box which is wholly interiorly divided into four chambers. The external panel 32 has one side, along the internal surface of which is bonded vertically a pair of reinforcing square paper tubes 33, 34**.

In assembly of these box forming portions on the pallet 21, the lower ends of two sets of the partition plates 31 are inserted into the grooves 29 formed between the receiving frames 28 and stood upright so as to provide a cross-like configuration as viewed from the top. And the bottom plate 30 is placed on the bottom inside the each of thus partitioned partition plate, and articles to be received are stacked and received on the bottom plate. When a requested height of the articles is reached, the lower end of the external panel 32 is inserted into the groove 29 and stood upright so as to surround each of the corner portions of the partition plate, then two sets of partition plates 31 and four external panels constitute a box. Then, articles to be received are further received into the box in such a manner as to be stacked, and finally, lids 13, 14 which are substantially the same as those in the first embodiment are placed one above the other and covered. And the box as well as the pallet 21 are tied, as necessary, with strings, ropes, or the like whereby assuming a packed condition as in FIG. 3 of the first embodiment.

In case that the emptied boxes are transported or stored, as shown in FIG. 7, two sets of partition plates are spread and placed one over another, four external panels are also spread and placed one over another, all of these component parts are put away into one lid 13 and the other lid 14 is covered thereon, thus they are arranged without being dismembered and are received into the upright wall 26 of the pallet 21 and tied with strings. In this way, a small compact package as shown in FIG. 4 of the first embodiment may be obtained to facilitate transportation and storage thereof.

Figure 9:
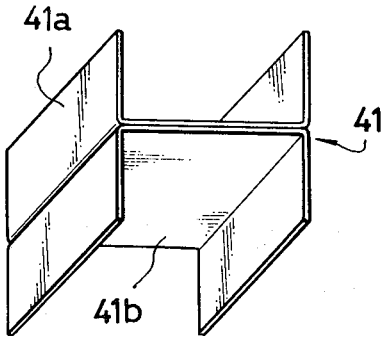
FIG. 9 is a perspective view showing the structure of one of partition plates in the third embodiment.
Figure 8:
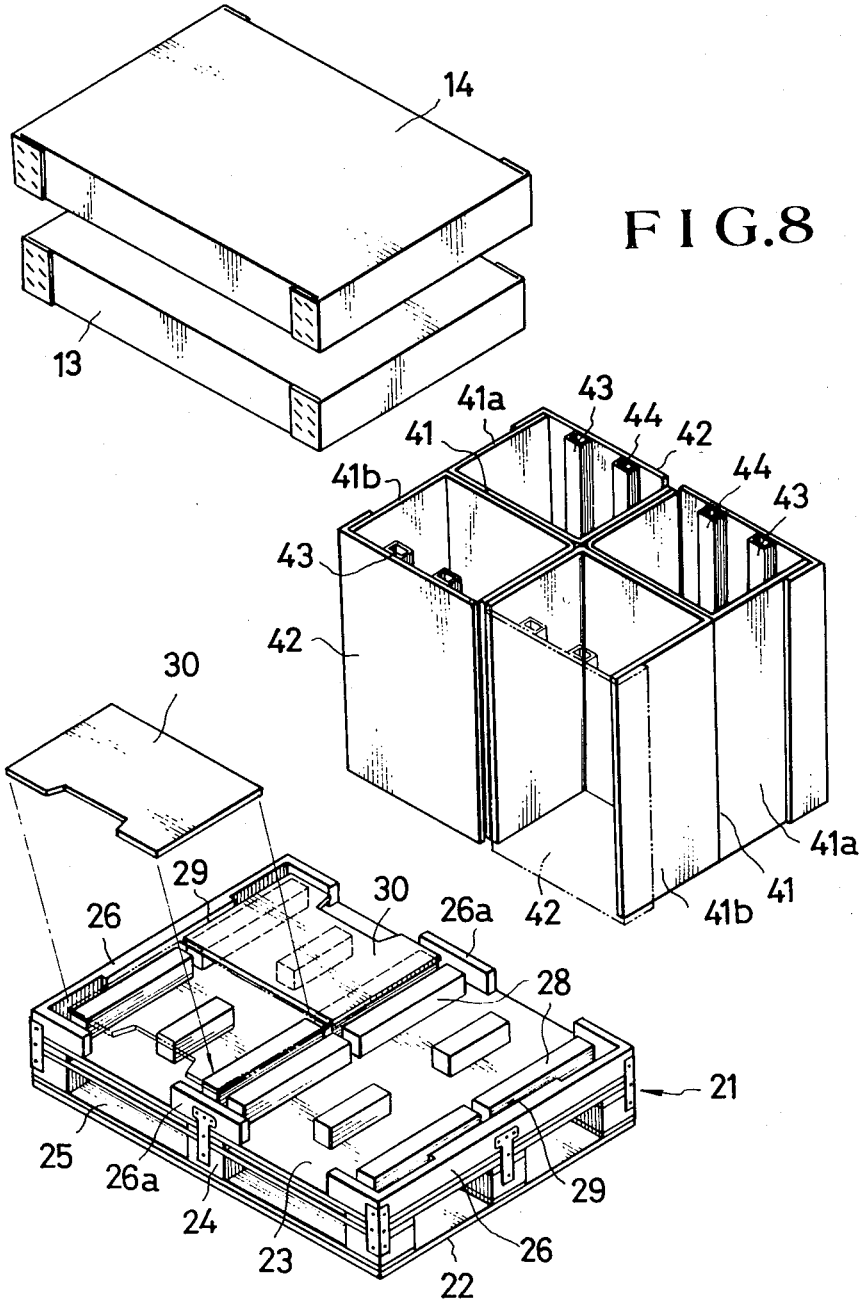
FIG. 8 illustrates a third embodiment and is a perspective view thereof with each of component parts when in use exploded.

FIGS. 8 and 9 illustrate a third embodiment in which the shape of a pallet and the shape of partition plates are slightly modified and which is substantially the same as that of the second embodiment. Thus, like parts in FIGS. 8 and 9 are given like numerals in the previous embodiment and the explanation therefor will not further be made.

In this third embodiment, partially cutaway portions in the upright wall of the pallet 21 are a pair of other opposed sides, and a receiving frame 28 is constituted by three prisms. A groove 29 formed between the receiving frame and the upright walls 26, **26*a*** is likewise present.

The box forming portion assembled on the pallet is constructed such that as shown in FIG. 9, a partition plate 41 has two U-shaped panels **41*a* and 41*b* arranged opposedly each other and glued or stitched, two sets of which are used to form four receiving chambers. Plate-like external panels 42 are placed in contact with openings of the aforementioned partition plate to form a box-like configuration. A pair of reinforcing members 43, 44 formed from square paper tubes are bonded longitudinally to the internal surfaces of the external panels 42**.

The operation of assembling the box forming portions in the third embodiment is accomplished similarly to the second embodiment wherein first, two sets of partition plates 41 are stood upright on the pallet 21, the bottom plate 30 is placed on the bottom of each receiving portion, the articles to be received are successively stacked on the bottom plate, the external panel 42 is disposed on the opening side of each partition plate when the articles reached a predetermined height, the lower end thereof is inserted into the groove 29 to stand it up, the articles to be received are further received, the lids 13, 14 are then placed one above the other and covered, and the thus formed box as well as the pallet 21 are tied with strings or ropes to form a package similar to that shown in FIG. 3 of the first embodiment.

In case that the emptied boxes are transported or stored, they are folded as in the aforementioned second embodiment and the box forming members are received into the lids 13 and 14, which are tied along with the pallet, then these are put together as shown in FIG. 4 of the first embodiment.

While in any of embodiments, the wooden pallet and the box forming portion made of corrugated cardboard are combined to form a container, it should be noted that their blanks are not limited to those used in the embodiments. The box portions made of corrugated cardboard are capable of being separated and folded at the respective portions, and even if a portion is torn, the other part can be substituted in nature and therefore, the present device is useful for the material saving and since the internal partitions may be varied freely within a given range, the variety of use is enhanced.

Moreover, when the container is not used, the box forming members may be folded into smaller size so that they may be tied together with the pallet with the result that common effects may be achieved in that both transportation and storage management are accomplished very easily.

What is claimed is:

1. A container comprising a pallet having a frame-like upright wall disposed on an upper deck thereof, a box forming member made of corrugated cardboard assembled on said pallet, and a plurality of receiving frames provided on said upper deck within said upright wall thereby forming grooves between said receiving frames and said upright wall; said box forming member comprising two sets of foldable partition plates in which each set includes a pair of L-shaped panels secured back-to-back, four L-shaped external panels which form corner portions, at least one bottom plate, and a pair of lids; said box forming member, wherein when in use, said bottom plate is positioned overlying said receiving frames, lower ends of said partition plates are inserted into said grooves between said upright wall and said receiving frames and stood upright internally of said upright wall, lower ends of said external panels are inserted into said grooves and stood upright internally of said upright wall, and said lids are positioned one within the other over the upper ends of said partition plates and said external panels whereby the internal space surrounded by said partition plates and said external panels are used as separate receiving portions; and said box forming member, wherein when not in use, said partition plates in their folded from, said external panels, and said bottom plate are received between said lids which provide a storage receptacle therefore.

2. The container as set forth in claim 1 further including subpartition plates arranged within said receiving portion formed by said partition plates and said external panels for further internally partitioning thereof.

3. The container as set forth in claim 1 wherein said upright wall is partially cut away.

4. A container comprising a pallet having a frame-like upright wall disposed on an upper deck thereof, a box forming member made of corrugated cardborad assembled on said pallet, and a plurality of receiving frames provided on said upper deck within said upright wall forming grooves between said receiving frames and said upright wall; said box forming member comprising two sets of foldable partition plates in which each set includes a pair of U-shaped panels secured back-to-back, four U-shaped external panels which form side portions, at least one bottom plate, and a pair of lids; said box forming member, wherein when in use, said bottom plate is positioned overlying said receiving frames, lower ends of said partition plates are inserted into said grooves between said upright wall and said receiving frames and stood upright internally of said upright wall, lower ends of said external panels are inserted into said grooves and stood upright internally of said upright wall, and said lids are positioned one within the other over the upper ends of said partition plates and said external panels whereby the internal space surrounded by said partition plates and said external panels are used as separate receiving portions; and said box forming member, wherein when not in use, said partition plates in their folded form, said external panels, and said bottom plate are received between said lids which provide a storage receptacle therefore.

5. The container as set forth in claim 4 further including subpartition plates arranged within said receiving portion formed by said partition plates and said external panels for further internally partitioning thereof.

6. The container as set forth in claim 4 wherein said upright wall is partially cut away.

* * * * *